US007769306B2

(12) United States Patent
Able et al.

(10) Patent No.: US 7,769,306 B2
(45) Date of Patent: Aug. 3, 2010

(54) STORING PRINTER DENSITY CONTROL PARAMETERS IN CARTRIDGE MEMORY

(75) Inventors: Douglas Anthony Able, Shelbyville, KY (US); William Keith Richardson, Salvisa, KY (US); Joel Patrick Wittenauer, Shelbyville, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 11/323,733

(22) Filed: Dec. 30, 2005

(65) Prior Publication Data

US 2007/0154227 A1 Jul. 5, 2007

(51) Int. Cl.
*G03G 15/00* (2006.01)

(52) U.S. Cl. ..... 399/12

(58) Field of Classification Search ..... 399/12
See application file for complete search history.

(56) References Cited

U.S. PATENT DOCUMENTS

| | | | | |
|---|---|---|---|---|
| 5,272,503 | A | 12/1993 | LeSueur et al. | |
| 5,835,817 | A | 11/1998 | Bullock et al. | |
| 5,930,553 | A | 7/1999 | Hirst et al. | |
| 6,144,812 | A | 11/2000 | Ueno | |
| 6,616,260 | B2 | 9/2003 | Skene et al. | |
| 6,769,757 | B2 | 8/2004 | Skene et al. | |
| 6,914,621 | B2 | 7/2005 | Kojima | |
| 2004/0141763 | A1 * | 7/2004 | Tabb et al. | 399/24 |

* cited by examiner

*Primary Examiner*—David M Gray
*Assistant Examiner*—Joseph S Wong
(74) *Attorney, Agent, or Firm*—Taylor & Aust, P.C.

(57) ABSTRACT

Data may be obtained in the form of a printer control density table from a memory within a replacement toner cartridge. The cartridge may include parity bits to ensure the accuracy of the data.

12 Claims, 4 Drawing Sheets

STORING PRINTER DENSITY CONTROL PARAMETERS IN CARTRIDGE MEMORY

BACKGROUND

This invention relates generally to controlling the print density in printers.

Mono-laser printers may contain device parameters, commonly called operating points, that control the density or darkness of the print on a page. The density control parameters may be defined for each engine speed and also for special media types.

The operating points may be stored in tables in print engine firmware. The table values in the engine firmware are determined during the printer development cycle. A cartridge and printer pair determined to have nominal components is used to determine the values to be stored in the engine firmware tables.

A density control operating point table may have sixty rows that determine the laser power, duty cycle, and developer bias voltage. The density control operating point selected by the printer depends on the print engine speed, print resolution, user-selected darkness, media type, and other factors.

Changing the print engine's density control table is impractical after the start of printer production because of the large number of printers in customer' hands that would need to receive the revised firmware. Thus, print engine density control tables are modified through the use of adders that are stored in cartridge memory devices. The adders, stored in the cartridge memory devices, modify the index of the current density operating point table that is currently selected.

The resolution of available adjustment with an adder is limited. A four-bit value may used to encode an adder that has only 16 possible values. The adder is typically applied to more than one operating point table with the possibility of unintended effects.

Thus, there is a need for better ways to enable modification of density control tables.

DETAILED DESCRIPTION

Figure 1:
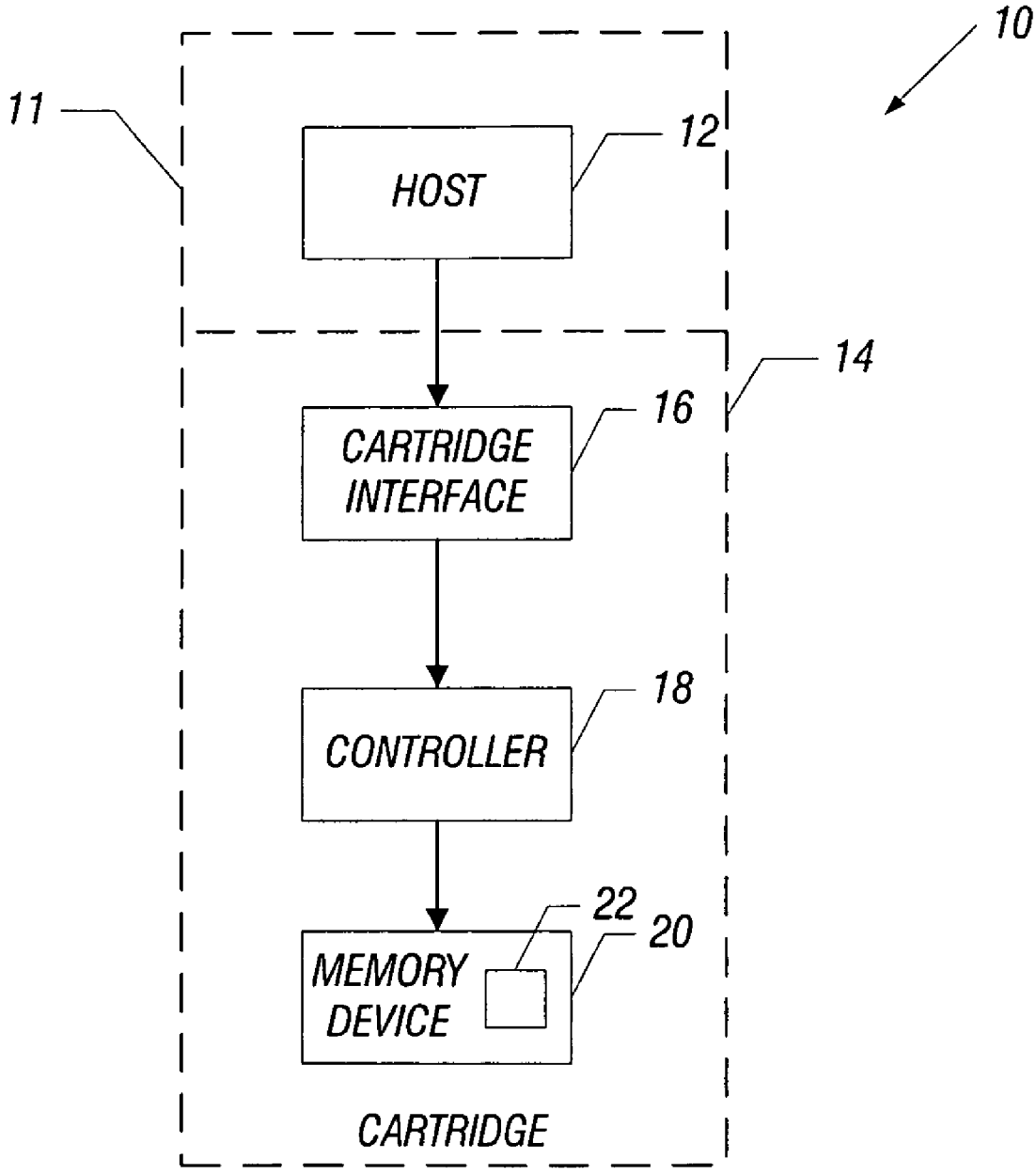
FIG. 1 is a schematic depiction of a printer with an installed toner cartridge.

Referring to FIG. 1, a toner cartridge 14 may be replaceably plugged into a host 12 via an appropriate receptacle. Thus, the toner cartridge 14 may be periodically replaced as toner is depleted. An electrical connection is automatically made between a host 12, in the form of a laser printer, and the toner cartridge 14 when the toner cartridge is properly installed. The host 12 may also be a programming apparatus that programs the cartridge 14 prior to its installation in a laser printer. The host 12 may include a housing 11.

The toner cartridge 14 may include an interface 16 to facilitate communication between a cartridge controller 18 and the host 12. The controller 18 also communicates with an on-board memory device 20. The memory device 20 may be any conventional memory, but a non-volatile memory, such as a flash memory, may be advantageous in some cases. The memory device 20 may store density control operating points 22 that enables updating of the printer density control table stored in the host 12.

Thus, in accordance with some embodiments of the present invention, when the toner cartridge 14 is replaced because the toner has been consumed, an updated printer density control table may be supplied with the toner cartridge 14. All that needs to be done is for the host 12, in this case the laser printer with the cartridge, to read out the data from the memory device 20 and to store it on board within the host 12. The host 12 may then implement the new printer density control table.

This solves the problem of how to update the printer density control table after production has begun when a large base of installed printers already exists and updating each one manually would be impractical. In this way, as cartridges of toner are consumed, the update of the printer density control table is provided with the replacement toner cartridge. In some cases, the printer density control table is not in need of updating, and in such case, cartridges may be distributed without the memory or with a memory which implements other functions.

Conventionally, the density control operating point data structure may include four fields. In one embodiment, the four fields are implemented through twenty-four bits or three bytes. Bits 0-7 may provide the developer bias voltage, bits 8-15 may provide the laser power, bits 16-22 give the laser duty index, and the parity bit may be bit 23 in one embodiment of the present invention. The most significant bit may be the parity bit used to check the integrity of the memory cells that store the data structure. The laser duty index is an index into a table to be included in the engine firmware that holds the available laser duty cycles. However, the illustration of the three fields and their uses may change over time and other data structures may be used as well.

Once installed within the host 12, the toner cartridge memory device 20 may be read out. The cartridge memory device 20 responds to a Read Data command from the host by extracting the first requested memory location from the message packet. The memory at the current address is then read. For reading density control operating points, a parity flag is set in the data packet. The cartridge memory device 20 performs a parity check on the three bytes of data making up the data structure. If the data at the current memory location fails the parity check, an error code may replace the three bytes of data in the response from the memory device 20 to the host 12. If the data structure passes the integrity check, the three bytes will be placed in a response data packet. The packet to be sent to the host or print engine in response to the read data command with parity may contain 180 data bytes in one example, made up of 60 data structures, each of three bytes.

Figure 2:
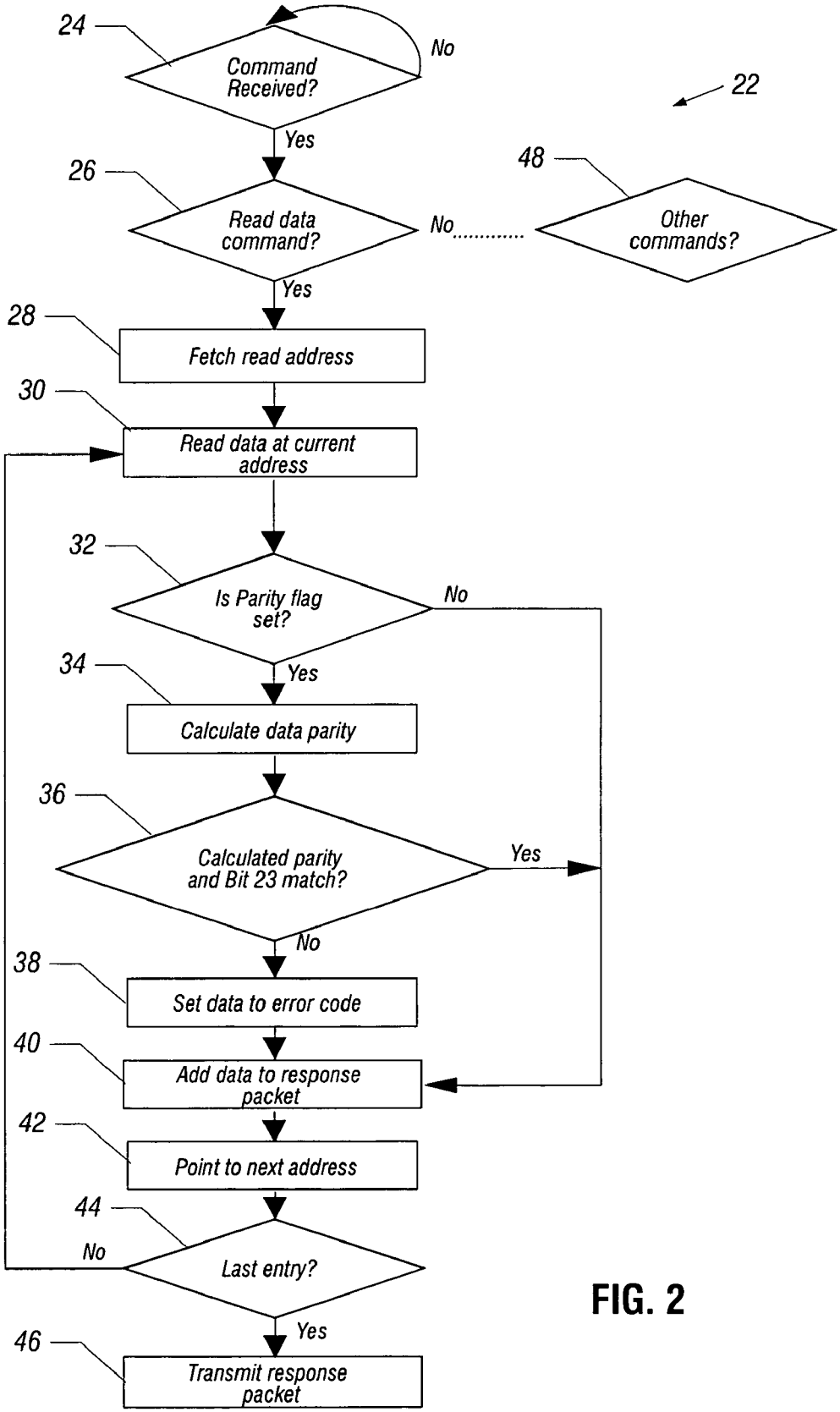
FIG. 2 is flow chart for a printer according to one embodiment of the present invention.

Referring to FIG. 2, the process 22, shown in FIG. 2, may be implemented from the memory device 20 by the cartridge 14. In some embodiments, the process may be implemented in software or firmware. Initially, a check of diamond 24 determines whether any command has been received from the host 12. If so, a check of diamond 26 determines whether the received command is a read data command. If so, the first read address is fetched, as indicated in block 28. The data at the current address is then read, as indicated in block 30. A check of diamond 32 determines whether a parity flag is set. If so, the data parity is calculated at block 34.

A check of diamond 36 determines whether the calculated parity and bit 23 match. If not, the data is set to an error code as indicated in block 38. If the calculated parity and the bit 23 match as determined in diamond 36, or if the parity flag is not set, the data is added to a response packet at block 40. Then the address pointer is set to the next address in block 42. Once the last entry is reached, as determined in diamond 44, a response packet is transmitted as indicated in block 46.

Figure 3:
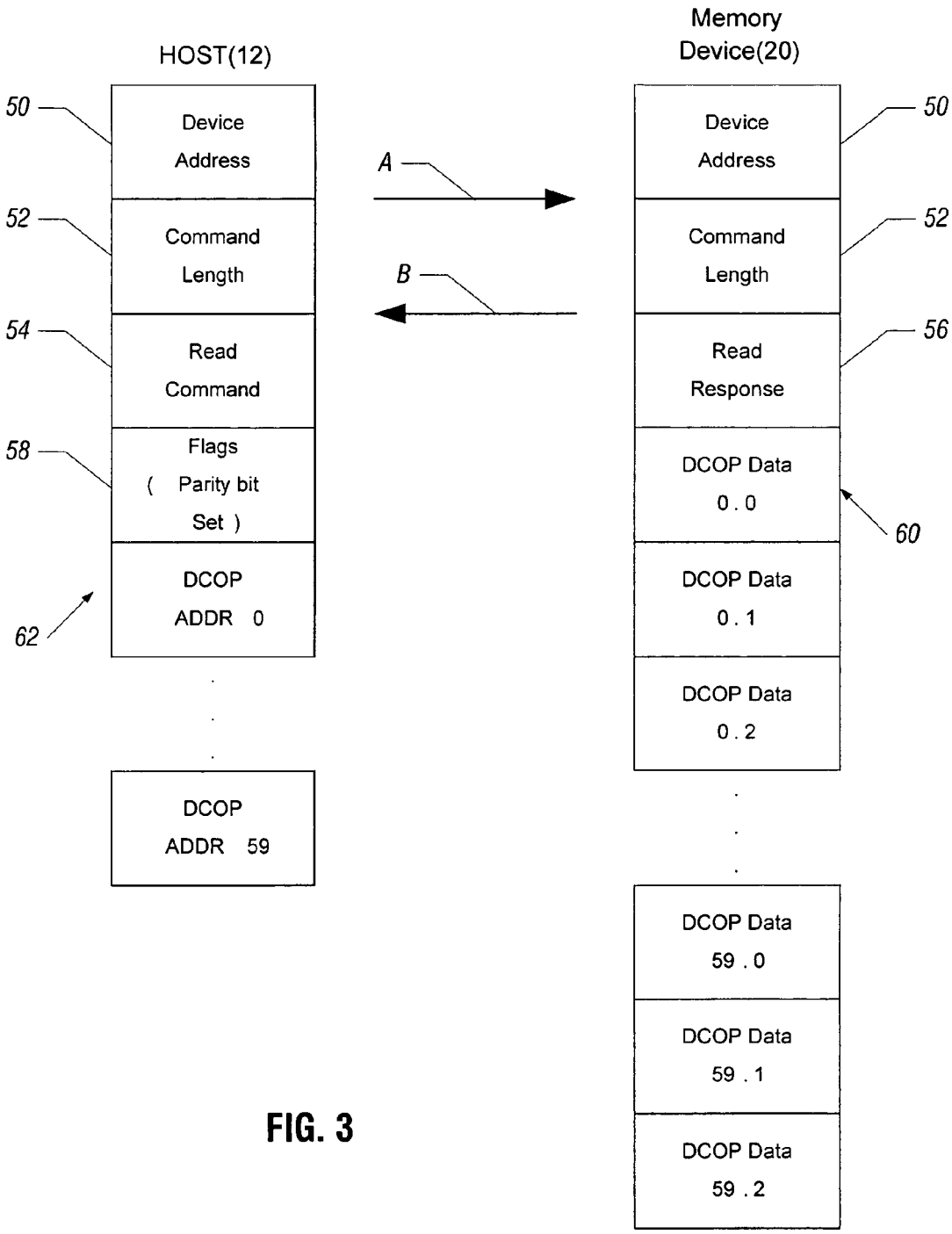
FIG. 3 shows a data exchange in accordance with one embodiment of the present invention in the course of a read data command.

Thus, referring to FIG. 3, a host read command may include a device address 50, a command length 52, a Read command 54, flags 58 (including parity flag), and addresses 0-59 for the sixty data structures.

In response to the read data command in the format on the left side of FIG. 3, the memory device responds with a memory read with parity response packet. The memory read with parity response packet may include the device address 50, the command length 52, a read response 56, and the requested data as indicated at 60. Thus, Density Control Operating Point (DCOP) data 0.0 to 0.2 are the three bytes of data for one address, et cetera, all the way through addresses 0-59.

Figure 4:
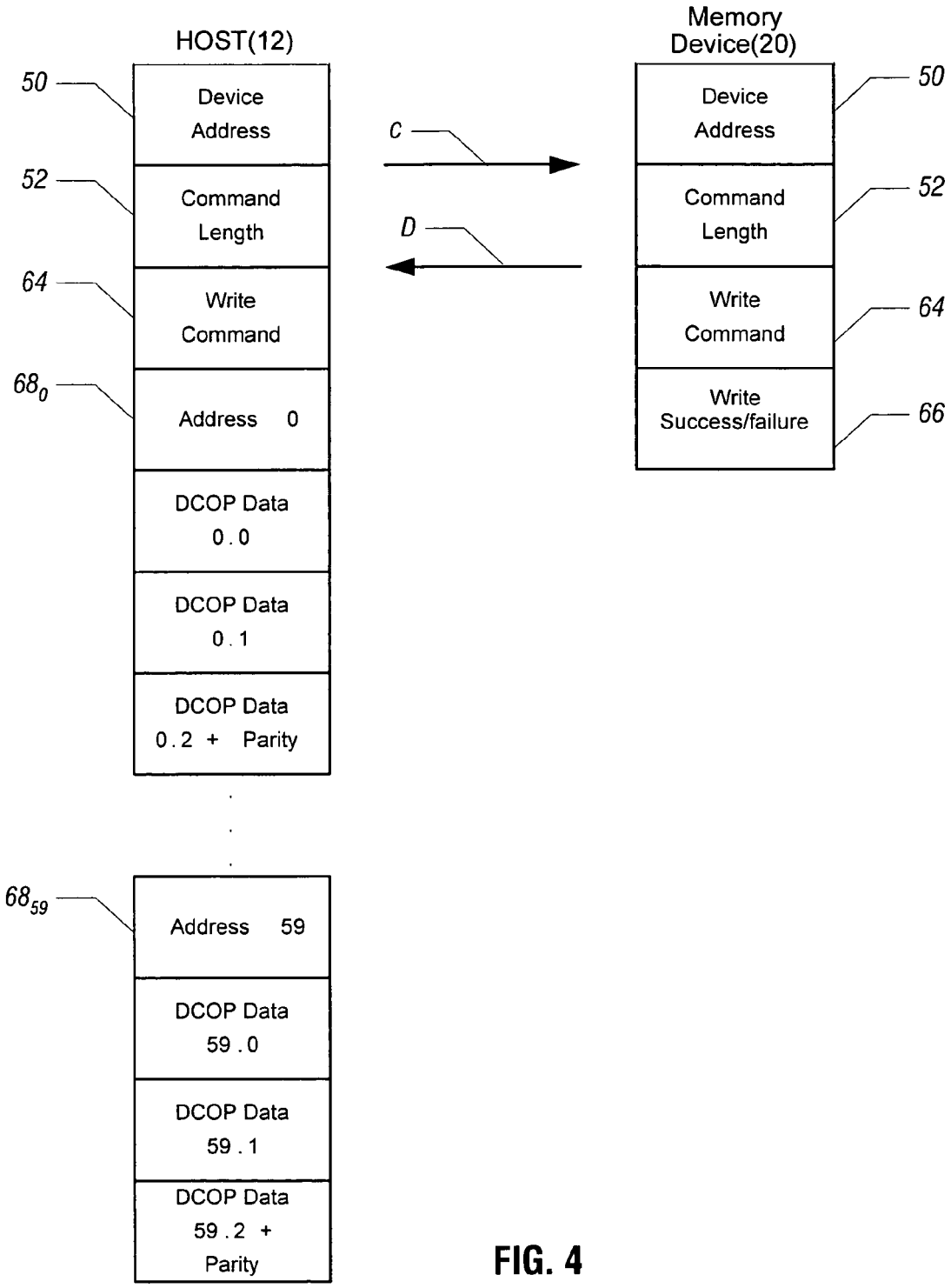
FIG. 4 shows a data exchange in response to a write data command in accordance with one embodiment of the present invention.

Thus, a programming host device writes the data density control operating point to the cartridge memory device at the time of cartridge manufacture. The programming host and the reading hosts are different devices. The programming host device is responsible for calculating the appropriate parity value for bit 23 before writing to the device. Thus, referring to FIG. 4, the write data command response transmission packet structure is shown. In this case, the programming host may be a programmer in a manufacturing facility. The host write command data structure includes the device address 50, a command length 52, a write command 64, and the addresses $\mathbf{68}_0$ through $\mathbf{68}_{59}$, each of which include the three bytes of data plus the parity bit in one embodiment.

The memory device 20 response to the write command may include a device address 50, a command length 52, a write command 64, and a write success or failure indicator 66 in some embodiments.

In this way, the cartridge 14 may be programmed at the factory and, when received and mounted appropriately as a replacement cartridge within a printer, the printer can read out the memory device obtaining the new printer density control tables. Because of the imposition of parity, the transfer of data may be implemented in a secure, error free fashion in some embodiments.

References throughout this specification to "one embodiment" or "an embodiment" mean that a particular feature, structure, or characteristic described in connection with the embodiment is included in at least one implementation encompassed within the present invention. Thus, appearances of the phrase "one embodiment" or "in an embodiment" are not necessarily referring to the same embodiment. Furthermore, the particular features, structures, or characteristics may be instituted in other suitable forms other than the particular embodiment illustrated and all such forms may be encompassed within the claims of the present application.

While the present invention has been described with respect to a limited number of embodiments, those skilled in the art will appreciate numerous modifications and variations therefrom. It is intended that the appended claims cover all such modifications and variations as fall within the true spirit and scope of this present invention.

What is claimed is:

1. A replacement toner cartridge for a printer having an existing print density control operating point table, comprising:

a memory device, the memory device storing data including an updated print density control operating point table from a programming host; and a controller coupled to the memory device and configured to perform a parity check on the data stored in the memory device and, when the replacement cartridge is installed in the printer, to send data including the updated print density control operating point table from the memory device to the printer depending upon the parity check wherein, when received by the printer, the updated print density control operating point table overwrites the existing print density control operating point table in the printer.

2. The replacement toner cartridge of claim 1, wherein the programming host is a programmer in a manufacturing facility.

3. The replacement toner cartridge of claim 1, wherein the controller receives a parity bit from the memory device, calculates data parity and compares the calculated data parity to the received parity bit to perform the parity check.

4. The replacement toner cartridge of claim 1, wherein the controller transmits the updated print density control operating point table to the printer when the replacement toner cartridge is installed in the printer and when the data passes the parity check.

5. The replacement toner cartridge of claim 1, wherein the controller transmits an error signal to the printer when the replacement toner cartridge is installed in the printer and when the data fails the parity check.

6. The replacement toner cartridge of claim 1, wherein the controller provides the updated print density control operating point table to the printer in response to a read request from the printer.

7. The replacement toner cartridge of claim 1, wherein the updated print density control operating point table includes data to be used by the printer to determine laser power, duty cycle and developer bias voltage.

8. A method of confirming and sending data from a memory device in a replacement toner cartridge installed in a printer having an existing print density operating point control table, comprising the steps of:

sending a read command to the memory device in the replacement toner cartridge, the memory device having data including an updated print density operating point control table previously programmed by a programming host;

checking parity of the previously programmed data at the toner cartridge; and transmitting the data to a printer based on the parity check, the data being transmitted with an error message if the parity check fails, and if no error message is received by the printer, overwriting the existing print density operating point control table in the printer with the updated print density operating point control table.

9. The method of claim 8, wherein the programming host device is a programmer in a manufacturing facility.

10. The method of claim 8, wherein the step of checking parity at the replacement toner cartridge comprises:

receiving a parity bit;

calculating a data parity; and comparing the calculated data parity to the received parity bit.

11. The method of claim 8, wherein the printer sends the read command including an address of a requested data and the replacement toner cartridge parity checks and transmits a confirmation message with the requested data to the printer if the parity check passes.

12. The method of claim 8, wherein the updated print density control operating point table includes data to be used by the printer to determine laser power, duty cycle and developer bias voltage.

* * * * *